US012613036B2

(12) United States Patent
Naik et al.

(10) Patent No.: US 12,613,036 B2
(45) Date of Patent: Apr. 28, 2026

(54) TURBINE ENGINE HAVING A COMBUSTION SECTION WITH A FUEL NOZZLE

(71) Applicant: General Electric Company, Schenectady, NY (US)

(72) Inventors: Pradeep Naik, Bengaluru (IN); Clayton Stuart Cooper, Loveland, OH (US); Steven C. Vise, Loveland, OH (US); Michael A. Benjamin, Cincinnati, OH (US); Michael T. Bucaro, Arvada, CO (US); Sibtosh Pal, Mason, OH (US); Andrew Joseph Wickersham, Liberty Township, OH (US); Karthikeyan Sampath, Bengaluru (IN)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 18/533,881

(22) Filed: Dec. 8, 2023

(65) Prior Publication Data

US 2025/0189132 A1 Jun. 12, 2025

(51) Int. Cl.
*F23R 3/28* (2006.01)
*F23R 3/30* (2006.01)

(52) U.S. Cl.
CPC ..... *F23R 3/286* (2013.01); *F23R 3/30* (2013.01); *F23R 3/283* (2013.01); *F23R 2900/00002* (2013.01)

(58) Field of Classification Search
CPC .. F23R 3/286; F23R 3/30; F23R 3/283; F23R 2900/00002
See application file for complete search history.

(56) References Cited

U.S. PATENT DOCUMENTS

| | | | |
|---|---|---|---|
| 4,408,461 | A | 10/1983 | Bruhwiler et al. |
| 4,982,570 | A | 1/1991 | Waslo |
| 5,836,164 | A | 11/1998 | Tsukahara |
| 6,067,789 | A | 5/2000 | Doebbeling |

(Continued)

FOREIGN PATENT DOCUMENTS

| | | | |
|---|---|---|---|
| DE | 920720 | C | 11/1954 |
| EP | 0877156 | A2 | 11/1998 |

(Continued)

OTHER PUBLICATIONS

Database WPI, Week 201218, Thomson Scientific, London, GB; AN 2012-C79687, XP002812955 & KR 110 010 144 B1 (2pages).

(Continued)

*Primary Examiner* — Phutthiwat Wongwian
*Assistant Examiner* — Rene D Ford
(74) *Attorney, Agent, or Firm* — Carter, DeLuca & Farrell LLP

(57) ABSTRACT

A turbine engine has a compressor section, a combustion section, and a turbine section in serial flow arrangement. The combustion section has a combustion liner and dome wall collectively forming at least a portion of a combustion chamber. The dome wall has a fuel nozzle opening. The combustion section has a fuel nozzle assembly extending through the fuel nozzle opening. The fuel nozzle assembly has a gaseous fuel supply, a compressed air supply, a mixer, a fuel nozzle and a first swirler.

19 Claims, 10 Drawing Sheets

(56) References Cited

U.S. PATENT DOCUMENTS

| | | | | |
|---|---|---|---|---|
| 6,367,262 | B1 | 4/2002 | Mongia et al. | |
| 7,017,329 | B2 | 3/2006 | Farhangi et al. | |
| 7,343,745 | B2 | 3/2008 | Inoue et al. | |
| 7,824,165 | B2 | 11/2010 | Davie et al. | |
| 7,891,190 | B2 | 2/2011 | Commaret et al. | |
| 8,066,509 | B2 | 11/2011 | Eroglu et al. | |
| 8,205,452 | B2 | 6/2012 | Boardman et al. | |
| 8,266,911 | B2 | 9/2012 | Evulet | |
| 10,180,256 | B2 | 1/2019 | Rullaud et al. | |
| 10,352,567 | B2 | 7/2019 | Wang et al. | |
| 10,731,861 | B2 | 8/2020 | Schlein | |
| 10,865,989 | B2 | 12/2020 | Sadasivuni | |
| 11,054,137 | B2 | 7/2021 | Choi | |
| 11,085,643 | B2 | 8/2021 | Freeman et al. | |
| 11,635,208 | B2 | 4/2023 | Choi | |
| 11,739,936 | B2 | 8/2023 | Bourgois et al. | |
| 2002/0192615 | A1* | 12/2002 | Moriya | F23D 14/02 431/278 |
| 2003/0106320 | A1 | 6/2003 | Ryan | |
| 2005/0106520 | A1 | 5/2005 | Cornwell et al. | |
| 2007/0003897 | A1 | 1/2007 | Koizumi et al. | |
| 2009/0111063 | A1 | 4/2009 | Boardman et al. | |
| 2010/0162716 | A1 | 7/2010 | Bastnagel et al. | |
| 2010/0275604 | A1 | 11/2010 | Hall | |
| 2010/0300102 | A1 | 12/2010 | Bathina et al. | |
| 2011/0162379 | A1 | 7/2011 | Baruah et al. | |
| 2011/0185703 | A1 | 8/2011 | Dodo et al. | |
| 2012/0151928 | A1 | 6/2012 | Patel et al. | |
| 2012/0208137 | A1* | 8/2012 | Kirzhner | F23R 3/36 431/12 |
| 2013/0199199 | A1 | 8/2013 | Moddemann | |
| 2014/0109582 | A1 | 4/2014 | Shershnyov et al. | |
| 2015/0000299 | A1 | 1/2015 | Zuo et al. | |
| 2015/0330575 | A1 | 11/2015 | Epstein et al. | |
| 2016/0010864 | A1 | 1/2016 | Abe et al. | |
| 2016/0290646 | A1 | 10/2016 | Abe et al. | |
| 2016/0377293 | A1 | 12/2016 | Short et al. | |
| 2017/0248318 | A1* | 8/2017 | Kulkarni | F23R 3/46 |
| 2017/0307218 | A1 | 10/2017 | Miyauchi et al. | |
| 2018/0299129 | A1 | 10/2018 | Parsania et al. | |
| 2019/0137103 | A1 | 5/2019 | Choi | |
| 2022/0003415 | A1* | 1/2022 | Shershnyov | F23D 14/70 |
| 2022/0412563 | A1 | 12/2022 | Giridharan et al. | |
| 2023/0204213 | A1 | 6/2023 | Naik et al. | |
| 2023/0204215 | A1 | 6/2023 | Naik et al. | |
| 2023/0296245 | A1 | 9/2023 | Kim et al. | |
| 2024/0344702 | A1* | 10/2024 | Boardman | F23R 3/34 |

FOREIGN PATENT DOCUMENTS

| | | | |
|---|---|---|---|
| EP | 2442026 | A1 | 4/2012 |
| EP | 2589876 | A1 | 5/2013 |
| EP | 4083511 | A1 | 11/2022 |
| WO | 9904196 | A1 | 1/1999 |
| WO | 2013/065624 | A1 | 5/2013 |
| WO | 2023/180318 | A1 | 9/2023 |

OTHER PUBLICATIONS

Extended European Search Report for application No. 24208316.0 dated Feb. 26, 2025, 10 pages.

European Office Action for Application No. 24 208 316.0 dated Mar. 20, 2026, 7 pages.

* cited by examiner

TURBINE ENGINE HAVING A COMBUSTION SECTION WITH A FUEL NOZZLE

TECHNICAL FIELD

The present subject matter relates generally to a turbine engine, and more specifically to a turbine engine having a combustion section including a fuel nozzle.

BACKGROUND

Turbine engines are driven by a flow of combustion gases passing through the engine to rotate a multitude of turbine blades, which, in turn, rotate a compressor to provide compressed air to the combustor for combustion. A combustor can be provided within the turbine engine and is fluidly coupled with a turbine into which the combusted gases flow.

The use of hydrocarbon fuels in the combustor of a turbine engine is known. Generally, air and fuel are fed to a combustion chamber, the air and fuel are mixed, and then the fuel is burned in the presence of the air to produce hot gas. The hot gas is then fed to a turbine where it cools and expands to produce power. By-products of the fuel combustion typically include environmentally unwanted byproducts, such as nitrogen oxide and nitrogen dioxide (collectively called $NO_x$), carbon monoxide (CO), unburned hydrocarbon (UHC) (e.g., methane and volatile organic compounds that contribute to the formation of atmospheric ozone), and other oxides, including oxides of sulfur (e.g., $SO_2$ and $SO_3$).

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION

Figure 1:
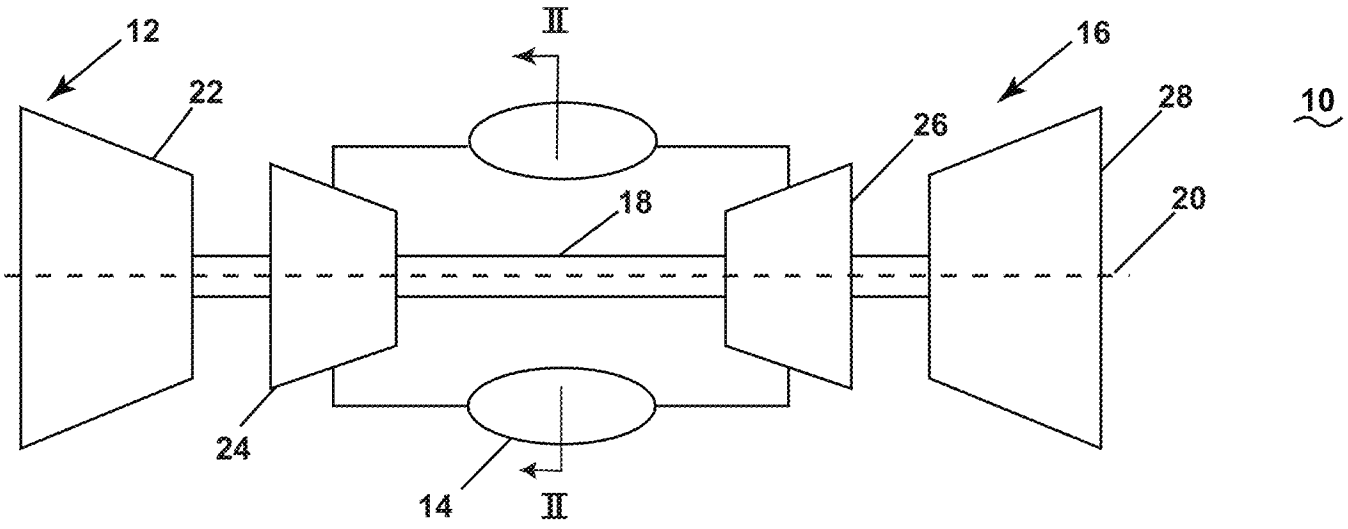
FIG. 1 is a schematic representation of a turbine engine, the turbine engine including a compressor section, a combustion section, and a turbine section.

Aspects of the disclosure described herein are directed to a turbine engine including a combustion section including a fuel nozzle assembly. The fuel nozzle assembly includes a mixer and a body. The body defines a first channel and a second channel. The mixer is fluidly coupled to the first channel. The first channel circumscribes or is circumscribed by the second channel. The first channel is fluidly coupled to a gaseous fuel supply. The second channel is fluidly coupled to a cooled bleed air from upstream of the combustion section.

The fuel nozzle assembly is especially well adapted for the use of hydrogen fuel (hereinafter, "H2 fuel"). Specifically, the fuel nozzle assembly is especially well adapted to feed a flow of gaseous H2 fuel to the combustion chamber. H2 fuels, when compared to traditional fuels (e.g., carbon fuels, petroleum fuels, etc.), have a higher burn temperature and velocity. Further, flashback can occur when using H2 fuels. As used herein, flashback refers to unintended flame propagation when the H2 fuel is combusted. H2 fuel has higher volatility, meaning that once the H2 fuel is combusted or ignited, the flame generated by the ignition of the H2 fuel can expand in undesired location; in other words, flashback can occur. For example, the flame can expand into the fuel nozzle or igniter. The fuel nozzle assembly, as described herein, ensures flashback of the H2 fuel does not occur. Auto-ignition of the H2 fuel can occur if the H2 fuel is too hot. Auto-ignition of the H2 fuel can be undesirable in certain locations of the combustion section. The fuel nozzle assembly as described herein ensures that the temperature of the H2 fuel is below the auto-ignition temperature until at least when it is desired to ignite the H2 fuel.

As used herein, the term "gaseous fuel" or iterations thereof reefers to a combustible fuel in a gaseous state. It will be appreciated that gaseous fuel is different from atomized fuel. Atomized fuel utilizes an impeller, orifices, or the like to take a liquid fuel and atomize the liquid fuel into very small droplets.

In some aspects, the gaseous fuel exits the fuel nozzle with a given speed and then mixes with air for combustion. As the fuel/air mixture burns, the flame propagates upstream. It can be desirable to control or maintain a constant flame in the combustor for ignition of subsequent fuel, and not to continually ignite the fuel with an ignitor.

For purposes of illustration, the present disclosure will be described with respect to a turbine engine (gas turbine engine). It will be understood, however, that aspects of the disclosure described herein are not so limited and that a fuel nozzle assembly as described herein can be implemented in engines, including but not limited to turbojet, turboprop, turboshaft, and turbofan engines. Aspects of the disclosure discussed herein may have general applicability within non-aircraft engines having a combustor, such as other mobile applications and non-mobile industrial, commercial, and residential applications.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first" and "second" may be used interchangeably to distinguish one component from another and are not intended to signify location or importance of the individual components.

The terms "forward" and "aft" refer to relative positions within a turbine engine or vehicle, and refer to the normal operational attitude of the turbine engine or vehicle. For example, with regard to a turbine engine, forward refers to a position closer to an engine inlet and aft refers to a position closer to an engine nozzle or exhaust.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

The term "fluid" may be a gas or a liquid. The term "fluid communication" means that a fluid is capable of making the connection between the areas specified.

Additionally, as used herein, the terms "radial" or "radially" refer to a direction away from a common center. For example, in the overall context of a turbine engine, radial refers to a direction along a ray extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

The singular forms "a", "an", and "the" include plural references unless the context clearly dictates otherwise. Furthermore, as used herein, the term "set" or a "set" of elements can be any number of elements, including only one.

As used herein, the term "radius of curvature" equals the radius of a circular arc which best approximates the curve at that point. A linear, or flat surface has a radius of curvature of zero. A curved surface, therefore, has a non-zero radius of curvature.

FIG. 1 is a schematic view of a turbine engine 10. As a non-limiting example, the turbine engine 10 can be used within an aircraft. The turbine engine 10 can include, at least, a compressor section 12, a combustion section 14, and a turbine section 16 in serial flow arrangement. A drive shaft 18 rotationally couples the compressor section 12 and the turbine section 16, such that rotation of one affects the rotation of the other, and defines a rotational axis or engine centerline 20 for the turbine engine 10.

The compressor section 12 can include a low-pressure (LP) compressor 22, and a high-pressure (HP) compressor 24 serially fluidly coupled to one another. The turbine section 16 can include an LP turbine 26, and an HP turbine 28 serially fluidly coupled to one another. The drive shaft 18 can operatively couple the LP compressor 22, the HP compressor 24, the LP turbine 26 and the HP turbine 28 together. Alternatively, the drive shaft 18 can include an LP drive shaft (not illustrated) and an HP drive shaft (not illustrated). The LP drive shaft can couple the LP compressor 22 to the LP turbine 26, and the HP drive shaft can couple the HP compressor 24 to the HP turbine 28. An LP spool can be defined as the combination of the LP compressor 22, the LP turbine 26, and the LP drive shaft such that the rotation of the LP turbine 26 can apply a driving force to the LP drive shaft, which in turn can rotate the LP compressor 22. An HP spool can be defined as the combination of the HP compressor 24, the HP turbine 28, and the HP drive shaft such that the rotation of the HP turbine 28 can apply a driving force to the HP drive shaft which in turn can rotate the HP compressor 24.

The compressor section 12 can include a plurality of axially spaced stages. Each stage includes a set of circumferentially-spaced rotating blades and a set of circumferentially-spaced stationary vanes. The compressor blades for a stage of the compressor section 12 can be mounted to a disk, which is mounted to the drive shaft 18. Each set of blades for a given stage can have its own disk. The vanes of the compressor section 12 can be mounted to a casing which can extend circumferentially about the turbine engine 10. It will be appreciated that the representation of the compressor section 12 is merely schematic and that there can be any number of stages. Further, it is contemplated, that there can be any other number of components within the compressor section 12.

Similar to the compressor section 12, the turbine section 16 can include a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section 16 can be mounted to the casing in a circumferential manner. It is noted that there can be any number of blades, vanes and turbine stages as the illustrated turbine section is merely a schematic representation. Further, it is contemplated, that there can be any other number of components within the turbine section 16.

The combustion section 14 can be provided serially between the compressor section 12 and the turbine section 16. The combustion section 14 can be fluidly coupled to at least a portion of the compressor section 12 and the turbine section 16 such that the combustion section 14 at least partially fluidly couples the compressor section 12 to the turbine section 16. As a non-limiting example, the combustion section 14 can be fluidly coupled to the HP compressor 24 at an upstream end of the combustion section 14 and to the HP turbine 28 at a downstream end of the combustion section 14.

During operation of the turbine engine 10, ambient or atmospheric air is drawn into the compressor section 12 via a fan (not illustrated) upstream of the compressor section 12, where the air is compressed defining a compressed air. The compressed air can then flow into the combustion section 14 where the compressed air is mixed with fuel and ignited, thereby generating combustion gases. Some work is extracted from these combustion gases by the HP turbine 28, which drives the HP compressor 24. The combustion gases are discharged into the LP turbine 26, which extracts additional work to drive the LP compressor 22, and the exhaust gas is ultimately discharged from the turbine engine 10 via an exhaust section (not illustrated) downstream of the turbine section 16. The driving of the LP turbine 26 drives the LP spool to rotate the fan (not illustrated) and the LP compressor 22. The compressed airflow and the combustion gases can together define a working airflow that flows through the fan, compressor section 12, combustion section 14, and turbine section 16 of the turbine engine 10.

Figure 2:
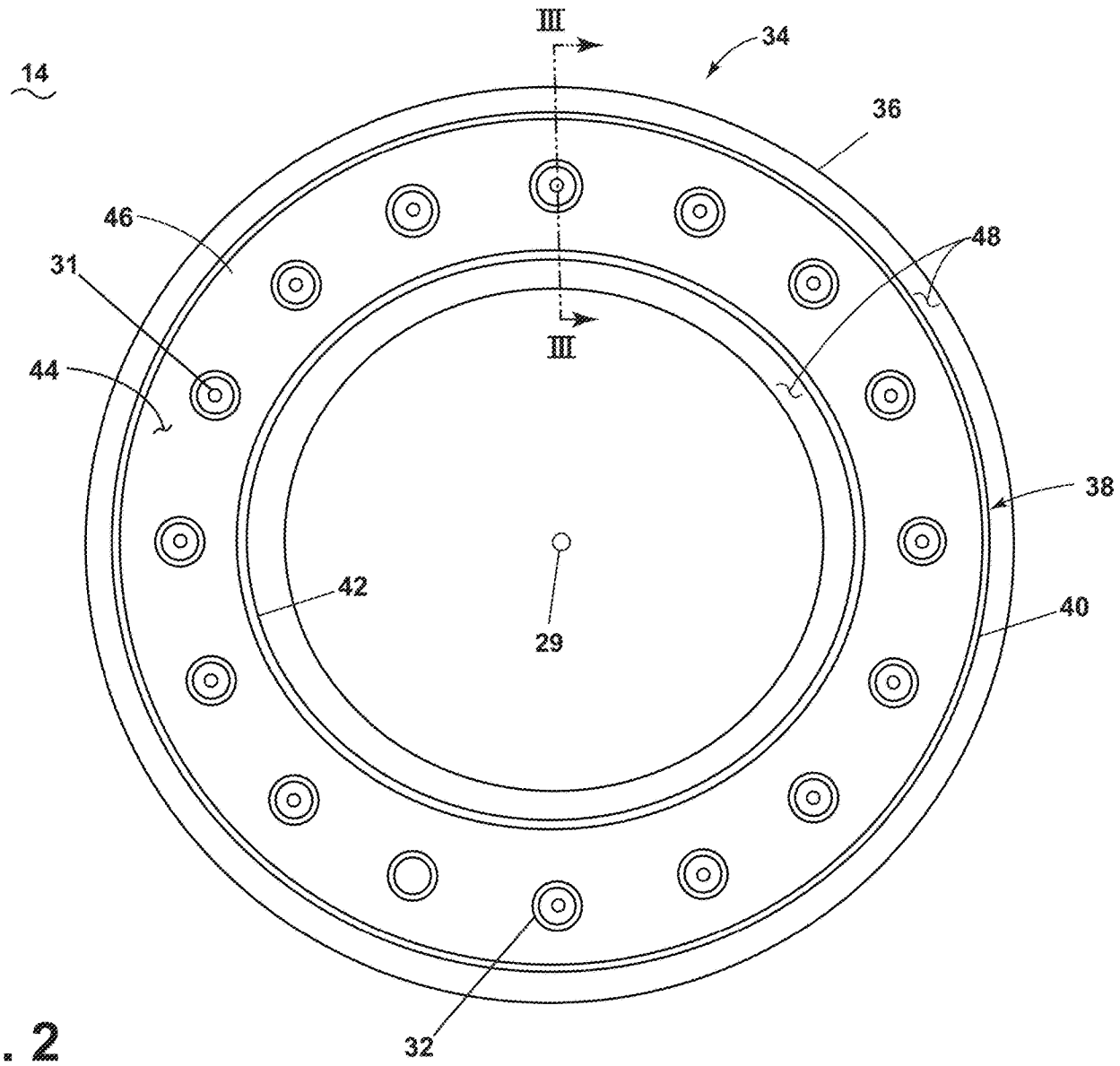
FIG. 2 depicts a cross-section view of the combustion section taken along line II-II of FIG. 1, further illustrating a set of fuel nozzles.

FIG. 2 depicts a cross-sectional view of the combustion section 14 along line II-II of FIG. 1. For purposes of illustration, the drive shaft 18 (FIG. 1) has been removed. The combustion section 14 includes a combustor 34. The combustor 34 includes a dome wall 44 including a set of fuel nozzle openings (not illustrated). The combustor 34 includes a set of fuel nozzles 32 extending through the set of fuel nozzle openings. The set of fuel nozzles 32 annularly arranged about a combustor centerline 29. The combustor centerline 29 can be the engine centerline 20 of the turbine engine 10. Additionally, or alternatively, the combustor centerline 29 can be a centerline for the combustion section 14, a single combustor, or a set of combustors that are arranged about the combustor centerline 29.

The set of fuel nozzles 32 are arranged about the combustor centerline 29. Each fuel nozzle of the set of fuel nozzles 32 includes a fuel nozzle centerline 31. The set of fuel nozzles 32 can include rich cups, lean cups, or a combination of both rich and lean cups annularly provided about the engine centerline 20 (FIG. 1). The combustor 34 is defined by a combustor liner 38. The combustor 34 can have a can, can-annular, or annular arrangement depending on the type of engine in which the combustor 34 is located. In a non-limiting example, the combustor 34 can have a combination arrangement as further described herein located within a casing 36 of the engine. The combustor liner 38, as illustrated by way of example, can be annular. The combustor liner 38 can include an outer combustor liner 40 and an inner combustor liner 42 concentric with respect to each other and annular about the engine centerline 20. The combustor liner 38 further defines the set of fuel nozzles 32. The dome wall 44 together with the combustor liner 38 can define a combustion chamber 46 annular about the engine centerline 20. The set of fuel nozzles 32 can be fluidly coupled to the combustion chamber 46. A compressed air passageway 48 can be defined at least in part by both the combustor liner 38 and the casing 36. Each fuel nozzle of the set of fuel nozzles 32 is defined by a discrete body extending through a respective portion of the dome wall 44 and being configured to exhaust a flow of gaseous fuel and compressed air into the combustion chamber 46.

Figure 3:
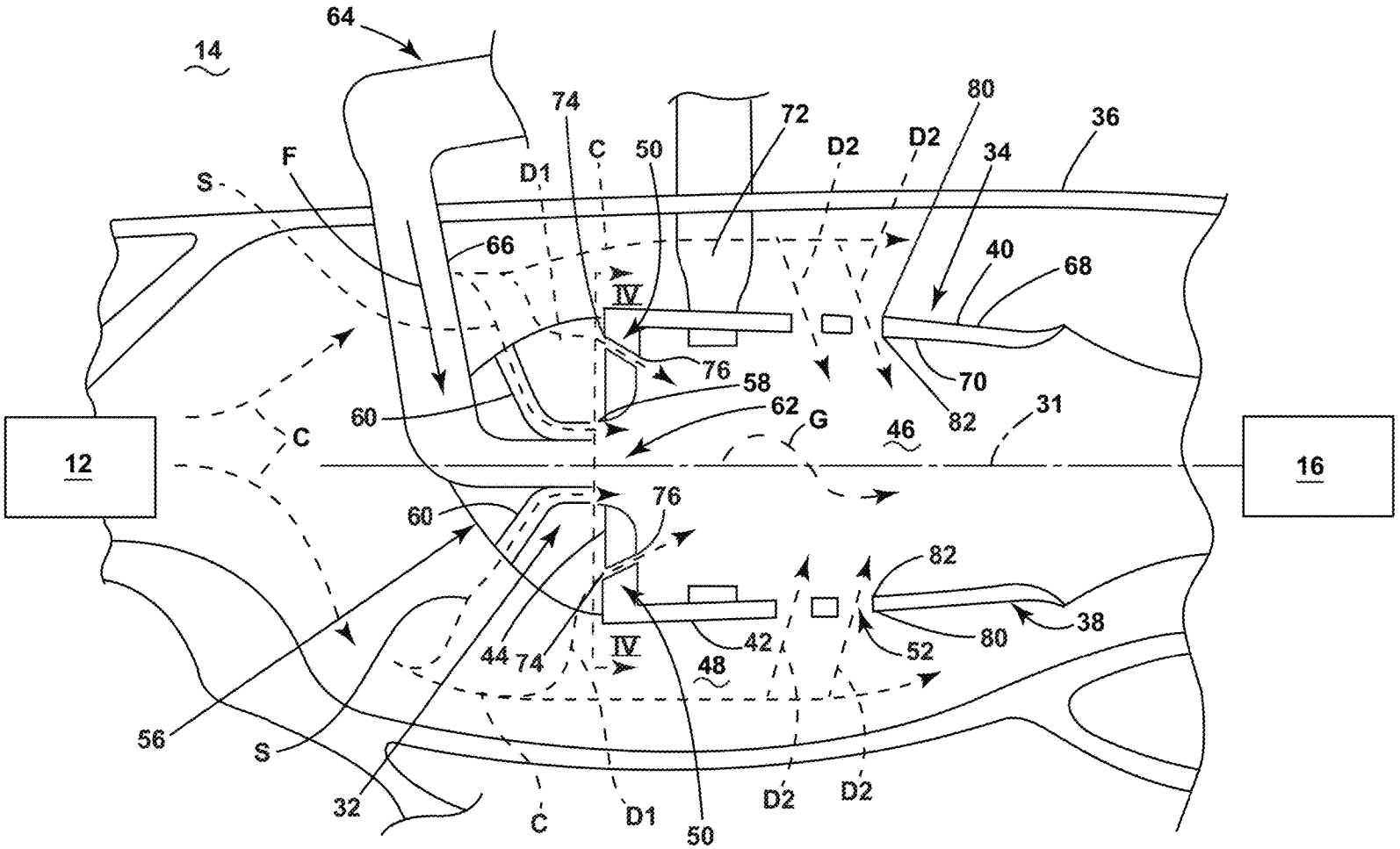
FIG. 3 is a schematic of a side cross-sectional view taken along line III-III of FIG. 2, further illustrating a fuel nozzle exhausting into a combustion chamber.

FIG. 3 depicts a cross-section view taken along line III-III of FIG. 2 illustrating the combustion section 14. At least one flame shaping hole can fluidly connect compressed air and the combustion chamber 46. By way of example, the at least one flame shaping hole is illustrated as first flame shaping holes 50 or second flame shaping holes 52. The combustor 34 can include the first flame shaping holes 50, the second flame shaping holes 52, or both the first flame shaping holes 50 and the second flame shaping holes 52.

The first flame shaping holes 50 can pass through the dome wall 44, fluidly coupling compressed air from the compressor section 12 or the compressed air passageway 48 to the combustion chamber 46.

The second flame shaping holes 52 can pass through the combustor liner 38, fluidly coupling compressed air from the compressed air passageway 48 to the combustion chamber 46.

The fuel nozzle 32 can be coupled to and disposed within a dome assembly 56. The fuel nozzle 32 can include a flare cone 58 and a swirler 60. The flare cone 58 includes an outlet 62 of the fuel nozzle 32 directly fluidly coupled to the combustion chamber 46. The fuel nozzle 32 is fluidly coupled to a fuel inlet 64 via a passageway 66. The fuel nozzle centerline 31 can be defined by the fuel nozzle 32, the flare cone 58, or the outlet 62.

Both the inner combustor liner 42 and the outer combustor liner 40 can have an outer surface 68 and an inner surface 70 at least partially defining the combustion chamber 46. The combustor liner 38 can be made of one continuous monolithic portion or be multiple monolithic portions assembled together to define the inner combustor liner 42 and the outer combustor liner 40. By way of non-limiting example, the outer surface 68 can define a first piece of the combustor liner 38 while the inner surface 70 can define a second piece of the combustor liner 38 that when assembled together form the combustor liner 38. As described herein, the combustor liner 38 includes the second flame shaping holes 52. It is further contemplated that the combustor liner 38 can be any type of combustor liner 38, including but not limited to a single wall or a double walled liner or a tile liner. An ignitor 72 can be provided at the combustor liner 38 and fluidly coupled to the combustion chamber 46, at any location, by way of non-limiting example upstream of the second flame shaping holes 52.

During operation, a compressed air (C) from a compressed air supply, such as the LP compressor 22 or the HP compressor 24 of FIG. 1, can flow from the compressor section 12 to the combustor 34. A portion of the compressed air (C) can flow through the dome assembly 56. A first part of the compressed air (C) flowing through the dome assembly 56 can be fed to the fuel nozzle 32 via the swirler 60 as a swirled airflow(S). A flow of fuel (F) is fed to the fuel nozzle 32 via the fuel inlet 64 and the passageway 66. The swirled airflow(S) and the flow of fuel (F) are mixed at the flare cone 58 and fed to the combustion chamber 46 as a fuel/air mixture. The ignitor 72 can ignite the fuel/air mixture to define a flame within the combustion chamber 46, which generates a combustion gas (G). While shown as starting axially downstream of the outlet 62, it will be appreciated that the fuel/air mixture can be ignited at or near the outlet 62.

A second part of the compressed air (C) flowing through one or more portions of the dome assembly 56 can be fed to the first flame shaping holes 50 as a first flame shaping airflow (D1). That is, a portion of the compressed air (C) from the compressor section 12 can flow through the dome wall 44 and into the combustion chamber 46 by passing through the first flame shaping holes 50. An inlet 74 is defined by a portion of one or more flame shaping holes of the first flame shaping holes 50. The inlet 74 is fluidly coupled to the compressed air (C). The first flame shaping airflow (D1) enters the one or more flame shaping holes of the first flame shaping holes 50 at the inlet 74 and exits the one or more flame shaping holes of the first flame shaping holes 50 at an outlet 76 located at the dome wall 44.

Another portion of the compressed air (C) can flow through the compressed air passageway 48 and can be fed to the second flame shaping holes 52 as a second flame shaping airflow (D2). In other words, another portion of the compressed air (C) can flow axially past the dome assembly 56 and enter the combustion chamber 46 by passing through the second flame shaping holes 52. That is, compressed air (C) can flow through the combustor liner 38 and into the combustion chamber 46 by passing through the second flame shaping holes 52.

The first flame shaping airflow (D1) can be used to direct and shape the flame. The second flame shaping airflow (D2) can be used to direct the combustion gas (G). In other words, the first flame shaping holes 50 or the second flame shaping holes 52 extending through the dome wall 44 or the combustor liner 38 direct air into the combustion chamber 46, where the directed air is used to control, shape, cool, or otherwise contribute to the combustion process in the combustion chamber 46.

The combustor 34 shown in FIG. 3 is well suited for the use of a hydrogen-containing gas as the fuel because it helps contain the faster moving flame front associated with hydrogen fuel, as compared to traditional hydrocarbon fuels. However, the combustor 34 can be used with traditional hydrocarbon fuels.

Figure 4:
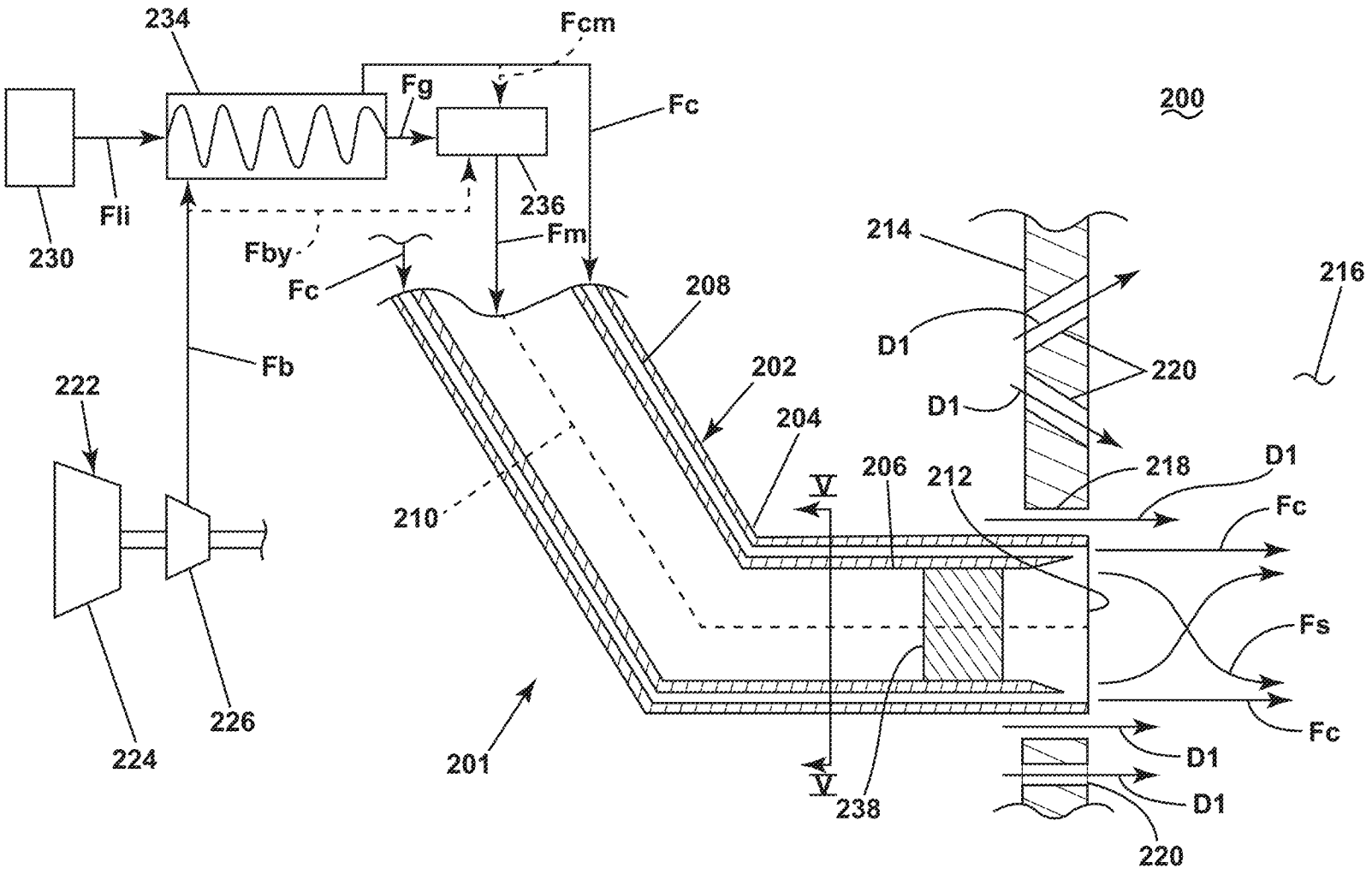
FIG. 4 is a schematic side cross-sectional view of a portion of a combustion section suitable for use as the combustion section of FIG. 1, the combustion section including a fuel nozzle assembly having a fuel nozzle, and a mixer.

FIG. 4 is a schematic side cross-sectional view of a portion of a combustion section 200 suitable for use as the combustion section 14 of FIG. 1. The combustion section 200 is similar to the combustion section 14; therefore, like parts will be identified with like names, with it being understood that the description of the combustion section 14 applies to the combustion section 200 unless noted otherwise.

The combustion section 200 is fluidly coupled to, but does not include a compressor section 222. The compressor section 222 can include one or more sections. As a non-limiting example, the compressor section 222 can include an HP compressor 226 and an LP compressor 224.

The combustion section 200 includes a dome wall 214 at least partially defining a combustion chamber 216. The combustion chamber 216, like the combustion chamber 46 (FIG. 3), is further defined by a combustion liner (not illustrated) (e.g., the inner combustor liner 42 and the outer combustor liner 40 of FIG. 3). The combustion section 200 includes a fuel nozzle assembly 201, like the set of fuel nozzles 32 (FIG. 2), that is provided through a fuel nozzle opening provided along the dome wall 214. The fuel nozzle assembly 201 includes a fuel nozzle 202 having a body 204 with a centerline axis 210.

The dome wall 214 can include a set of flame shaping holes 220. The set of flame shaping holes 220 exhaust to the combustion chamber 216. Each flame shaping hole 220 of the set of flame shaping holes 220 can extend, from left to right of the page, radially toward, radially away from, or parallel with the centerline axis 210.

A compressed air channel 218 can be formed between the dome wall 214 and the fuel nozzle 202. Alternatively, the dome wall 214 can be fluidly sealed against the fuel nozzle 202 such that the compressed air channel 218 is not formed therebetween. It will be appreciated that the fuel nozzle 202 can be free to radially move within the compressed air channel 218, with respect to the centerline axis 210. Alternatively, the fuel nozzle 202 can be statically mounted to a respective portion of the combustion section 200.

The body 204 defines a first channel 206 and a second channel 208. The body 204 defines the centerline axis 210. The first channel 206 terminates at and exhausts into the combustion chamber 216 at a first outlet 212. The second channel 208 terminates at and exhausts into the combustion chamber 216 at a second outlet 240. The first outlet 212 is aligned with or offset from the second outlet 240. The fuel nozzle assembly 201 includes a swirler 238 provided within the first channel 206. The swirler 238 is any suitable component configured to redirect a flow of fluid from an upstream edge of the swirler to a downstream edge of the swirler 238 such that the flow of fluid includes a helical or otherwise swirled flow downstream of the swirler 238. As a non-limiting example, the swirler 238 can be an airfoil or a plurality of airfoils provided within the first channel 206. The amount of swirl to the flow of fluid that flows over or through swirler 238 can be quantified by a swirl number defined as an integral of the tangential momentum to the axial momentum of the flow of fluid downstream of a respective swirler. The swirler 238 is defined as a swirler that creates a swirled airflow having swirl number of greater than or equal to 0.2 and less than or equal to 1.2.

The fuel nozzle assembly 201 can include a liquid fuel supply 230, a heat exchanger 234, and a mixer 236. At least one of the liquid fuel supply 230, the heat exchanger 234, the mixer 236, or a combination thereof, can be provided within or outside of the combustion section 200 or turbine engine. As a non-limiting example, the liquid fuel supply 230 can be provided within a section of an aircraft or vehicle that the turbine engine is coupled to. The liquid fuel supply 230 can include a hydrogen fuel (hereinafter, "H2 fuel"). The fuel within the liquid fuel supply 230 is in a liquid state. The fuel within the liquid fuel supply 230 is converted to a gaseous state prior to being fed to the fuel nozzle 202. As a non-limiting example, the liquid fuel supply 230 can include a 100% H2 fuel.

The combustion section 200 can include any number of one or more fuel nozzle assemblies 201. Each fuel nozzle assembly 201 is defined by a portion of the combustion section 200 extending through a respective singular portion of the dome wall 214 (e.g., a respective fuel nozzle opening) and having a single gaseous fuel supply. Each fuel nozzle assembly 201 includes at least one first outlet 212 exhausting into the combustion chamber 216 and being circumscribed by the dome wall 214.

During operation, a flow of compressed air, a flow of gaseous fuel, or a combination thereof, is fed to the first channel 206 and the second channel 208. The flow of compressed air can be, for example, from the compressor section 222. As a non-limiting example, a bleed air (Fb) can be drawn from a portion of the turbine engine (e.g., the turbine engine 10 of FIG. 1) upstream of the combustion chamber 216. As a non-limiting example, the bleed air (Fb) can be drawn from the HP compressor 226, an upstream portion of the combustion section 200, or any other suitable portion of the turbine engine having a flow of compressed air. The flow of bleed air (Fb) is fed to at least one of the heat exchanger 234, the mixer 236 as a flow of bypass bleed air (Fby), directly to the fuel nozzle 202, or a combination thereof.

The flow of gaseous fuel begins as a flow of liquid (Fli) from the liquid fuel supply 230. The flow of liquid (Fli) is fed to the heat exchanger 234. As the heat exchanger 234 is also fluidly coupled to the flow of compressed air (e.g., the flow of bleed air (Fb)), heat is transferred to the flow of liquid (Fli) from the flow of compressed air. It is contemplated that the heat transferred to the flow of liquid (Fli) is sufficient to cause a phase change of liquid to gas such that a flow of gaseous fuel (Fg) exits the heat exchanger 234. As such, the flow of bleed air (Fb) can be from any suitable portion of the turbine engine that includes a flow of compressed air at a temperature high enough to cause a phase change from liquid to gas of the liquid hydrogen fuel within the heat exchanger 234. As the flow of compressed air heats the flow of liquid (Fli), the flow of compressed air is cooled while flowing through the heat exchanger 234 such that a flow of cooled air (Fc) exits the heat exchanger 234.

The flow of gaseous fuel (Fg) can be fed directly to the fuel nozzle 202 or to the mixer 236 separate from the fuel nozzle 202. The mixer 236 is further fluidly coupled to the flow of compressed air; specifically at least one of the flow of bleed air (Fb) through a flow of bypass bleed air (Fby), to the flow of cooled air (Fc) as a flow of mixing cooled air (Fcm), or a combination thereof. The fluid that exits the mixer 236 is defined as a flow of fuel/air mixture (Fm). A ratio between the flow of compressed air to the flow of gaseous fuel within the flow of fuel/air mixture (Fm) can be greater than or equal to 2. The flow of fuel/air mixture (Fm) is fed to the first channel 206, while a flow of compressed air (e.g., the flow of cooled air (Fc)) is fed to the second channel 208. As the flow of compressed air fed to the second channel 208 can be the flow of bleed air (Fb), the flow of cooled air (Fc), or a combination thereof, it will be appreciated that the fuel nozzle assembly 201 includes a compressed air supply that includes the flow of bleed air (Fb), the flow of cooled air (Fc), or a combination thereof. The flow of gaseous fuel (Fg) can contain 100% hydrogen ("H2") fuel or a mixture of hydrogen fuel and another gaseous fuel (e.g., methane). Alternatively, the flow of gaseous fuel (Fg) can be a mixture of H2 fuel and compressed air from, for example, the compressor section (e.g., the compressor section 12 of FIG. 1).

The flow of fuel/air mixture (Fm) flows through the first channel 206 and over the swirler 238 to create a swirled flow of fuel (Fs) that is fed directly into the combustion chamber 216. The flow of cooled air (Fc) is fed directly to the combustion chamber 216 through the second outlet 240. The second outlet 240 can be provided radially outward from the first outlet 212 such that the flow of cooled air (Fc) within the combustion chamber 216 surrounds the swirled flow of fuel (Fs). A flow of flame shaping airflow (D1), defined by a compressed airflow similar to the first flame shaping airflow (D1) of FIG. 3, can be fed to the combustion chamber 216 through the set of flame shaping holes 220, the compressed air channel 218, or a combination thereof. The flow of flame shaping airflow (D1) can be provided radially outward from the flow of cooled air (Fc).

The swirled flow of fuel (Fs) can then be ignited within the combustion chamber 216 to define a flame within the combustion chamber 216. The flow of cooled air (Fc) is used to shape the flame (e.g., provide a desired footprint of the physical flame within the combustion chamber), and insulate various portions of the combustion section 200 from the flame. The flame shaping is done by forming an annular curtain of compressed air around the flame. As a non-limiting example, the second channel 208 is oriented such that the flow of cooled air (Fc) that is fed out of the second outlet 240 forms an annular curtain of compressed air around the swirled flow of fuel (Fs). The annular curtain of compressed air, in turn, directs the flame or otherwise the swirled flow of fuel (Fs) in a desired direction and keeps the flame within desired boundaries at least partially defined by the annular curtain of compressed air. The annular curtain of compressed air further insulates various portions of the combustion section 200 (e.g., the dome wall 214, the combustor liner, etc.) from the heat of the flame by providing a layer of insulation between the flame and other sections of the combustion section 200 or otherwise cooling the other sections of the combustion section 200. The first flame shaping airflow (D1), like the flow of cooled air (Fc), can be used for further flame shaping and insulation.

The shaping of the flame and insulation between the flame and other portions of the combustion section 200 is especially important when utilizing a gaseous H2 fuel in comparison with traditional fuels. The gaseous H2 fuel has a higher burn temperature and tendency for flashback compared to the traditional fuels. As such, the flow of cooled air (Fc) is used to push the flame away from the fuel nozzle 202. The pushing of the swirled flow of fuel (Fs) away from the fuel nozzle assembly 201 helps ensure that flashback into the fuel nozzle 202 of the swirled flow of fuel (Fs), once ignited, does not occur. The flow of cooled air (Fc) further ensures that the flame, which burns hotter than a flame generated from the traditional fuels, does not overly heat sections of the combustion section 200. The flow of cooled air (Fc) can further be used to create a uniform flame distribution at the combustor outlet. It is contemplated that a uniform flame distribution or temperature distribution at the combustor outlet results in a higher efficiency of the turbine section.

Further, the flow of cooled air (Fc) keeps the flow of gaseous fuel (Fg) below the auto-ignition temperature of the gaseous fuel in order to ensure that the flow of gaseous fuel (Fg) is not prematurely ignited (e.g., within the fuel nozzle 202) due to exceeding a threshold temperature and auto-igniting. The flow of cooled air (Fc) can be fed to the second channel 208, while the flow of gaseous fuel (Fg) is fed to the first channel 206. A heat transfer between the flow of cooled air (Fc) within the second channel 208 and the flow of gaseous fuel (Fg) within the first channel 206 can occur within the fuel nozzle 202 such that a temperature of the flow of gaseous fuel (Fg) within the first channel 206 remains below the auto-ignition temperature of the flow of gaseous fuel (Fg)

It will be appreciated that the flow of gaseous fuel (Fg) exiting the heat exchanger 234 can be defined as a gaseous fuel supply of the fuel nozzle assembly 201. While described in terms of the gaseous fuel supply being the heat exchanger 234, it will be appreciated that the fuel nozzle assembly 201 can instead include a gaseous fuel supply rather than the liquid fuel supply 230, thus negating the need for the heat exchanger 234. The benefit of using the liquid fuel supply 230 and the heat exchanger 234 as opposed to only a gaseous fuel supply is that liquid H2 fuel has a higher density than gaseous H2 fuel. This, in turn, means that a container with a set volume can hold a greater amount (e.g., by mass) of liquid H2 fuel than gaseous H2 fuel.

While not illustrated, the combustion section 200 can include a controller module communicatively coupled to a set of valves in order to automatically control a flow of fluids to or within respective portions of the combustion section 200. As a non-limiting example, the controller module can automatically control a supply of the flow of bleed air (Fb) to at least one of the heat exchanger 234, the mixer 236 (as the flow of bypass bleed air (Fby)), the fuel nozzle 202, or a combination thereof. As a non-limiting example, the controller module can automatically control a supply of the flow of liquid (Fli) to the heat exchanger 234. As a non-limiting example, the controller module can automatically control a supply of the flow of cooled air (Fc) from the heat exchanger 234 and to at least one of fuel nozzle 202, the mixer 236 as the flow of mixing cooled air (Fcm), or a combination thereof. As a non-limiting example, the controller module can automatically control a flow of the gaseous fuel (Fg) to at least one of the mixer 236, the fuel nozzle 202, or a combination thereof. As a non-limiting example, the controller module can automatically control a flow of fuel/air mixture (Fm) to the fuel nozzle 202. As a non-limiting example, the controller module can automatically control a flow of compressed air to at least one of the compressed air channel 218, the set of flame shaping holes 220, or a combination thereof. The flow of fluids to or within respective portions of the combustion section 200 can be done independently of one another. As a non-limiting example, the flow of flame shaping airflow (D1) can be fed to the compressed air channel 218 but not the set of flame shaping holes 220.

Figure 5:
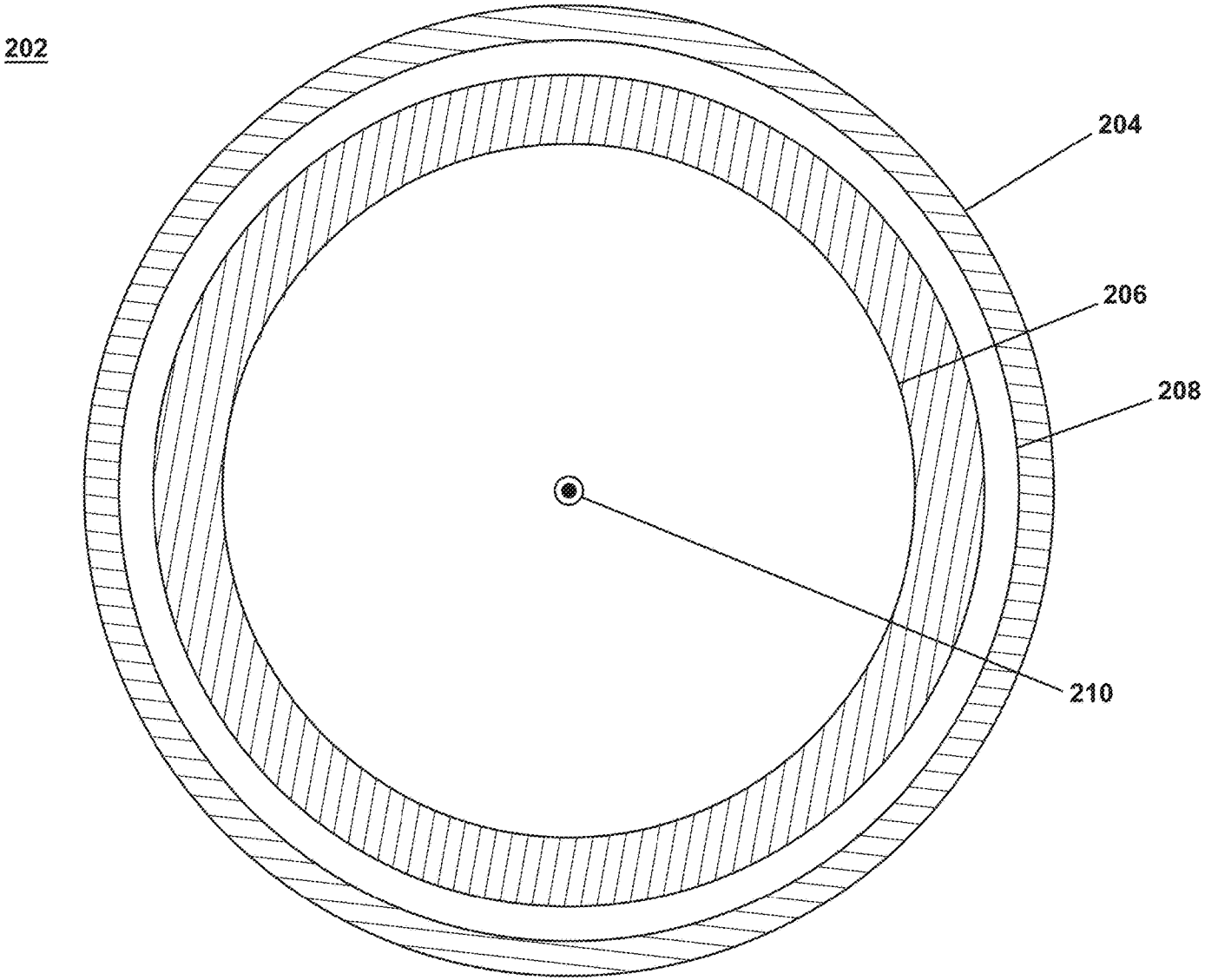
FIG. 5 is a schematic cross-sectional view of the fuel nozzle taken along line V-V of FIG. 4, further illustrating a first channel and a second channel.

FIG. 5 is a schematic cross-sectional view of the fuel nozzle 202 taken along sectional line V-V of FIG. 4. The second channel 208 and the first channel 206 are each formed as annular channels. The second channel 208 circumscribes the first channel 206. The first channel 206 and the second channel 208 can extend continuously about an entirety of the centerline axis 210. Alternatively, the second channel 208 or the first channel 206 can be segmented, non-continuous or otherwise extend about less than an entirety of the centerline axis 210. As a non-limiting example, the second channel 208 can be formed as a plurality of holes or channels circumferentially spaced about the centerline axis 210 and provided radially outward form the first channel 206.

While not illustrated, it will be appreciated that the fuel nozzle 202 can include structure physically coupling a portion of the body 204 defining the first channel 206 to a portion of the body 204 defining the second channel 208. As a non-limiting example, a set of swirlers similar to the swirler 238 can be provided within the second channel 208 and operably couple the two portions of the body 204 together.

Figure 6:
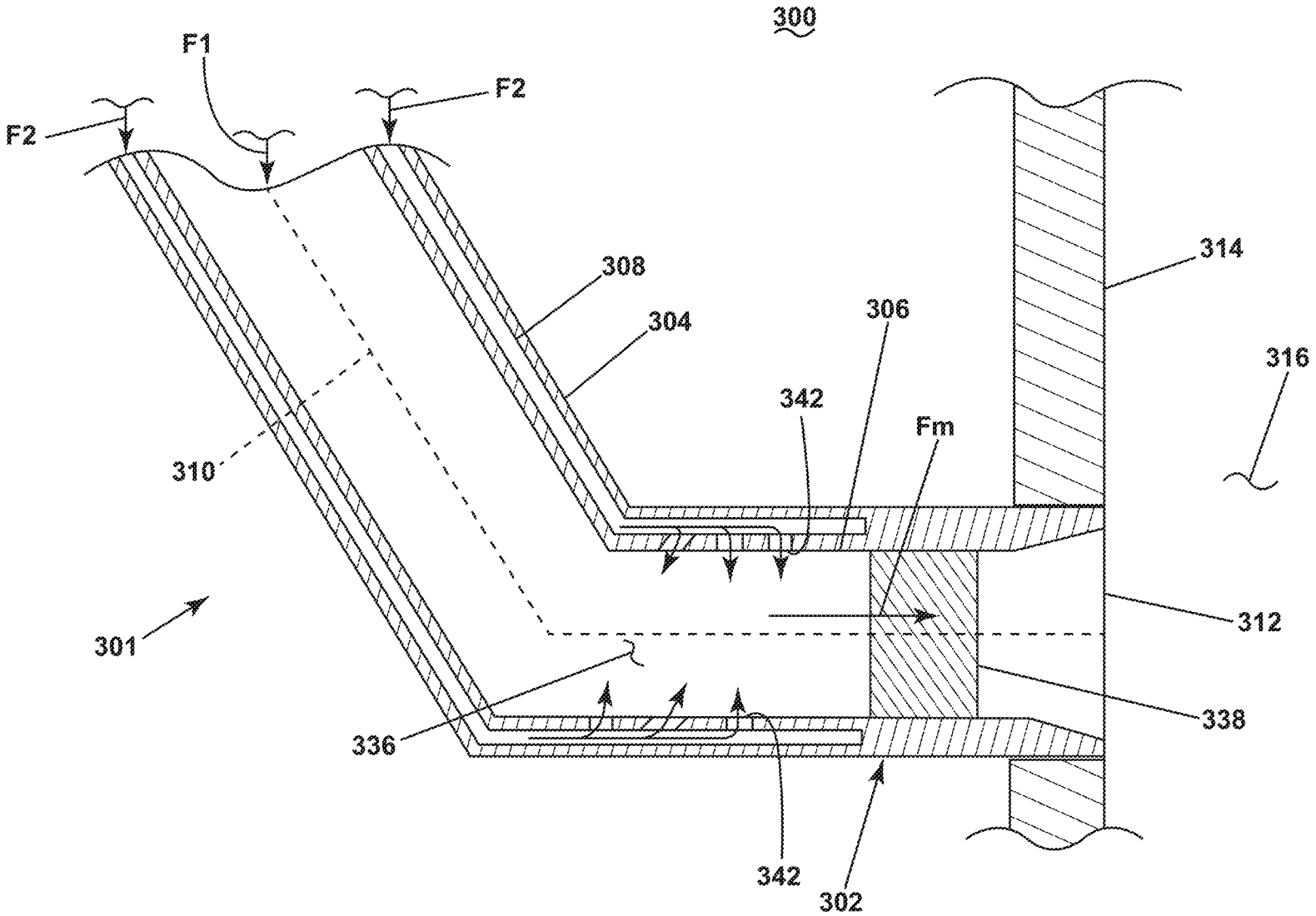
FIG. 6 is a schematic side cross-sectional view of an exemplary combustion section suitable for use as the combustion section of FIG. 1, the combustion section including a fuel nozzle including a first channel and a second channel fluidly coupled via a set of channels.

FIG. 6 is a schematic side cross-sectional view of an exemplary combustion section 300 suitable for use as the combustion section 200 of FIG. 1. The combustion section 300 is similar to the combustion section 200 (FIG. 4), therefore, like parts will be identified with like numerals increased to the 300 series with it being understood that the description of the combustion section 200 applies to the combustion section 300 unless noted otherwise.

The combustion section 300 includes a fuel nozzle assembly 301, a dome wall 314 and a combustion chamber 316. The fuel nozzle assembly 301 includes a fuel nozzle 302 having a body 304 defining a centerline axis 310. The body 304 defines a first channel 306 and a second channel 308. The first channel 306 exhausts into the combustion chamber 316 at a first outlet 312. A swirler 338 is provided within the first channel 306. While not illustrated, a set of flame shaping holes (e.g., the set of flame shaping holes 220 of FIG. 4) can be provided.

The fuel nozzle assembly 301 is similar to the fuel nozzle assembly 201 in that the fuel nozzle assembly includes the second channel 308 circumscribing the first channel 306. However, the fuel nozzle assembly 301 includes a mixer 336 formed within the body 304 of the fuel nozzle 302. A set of channels 342 fluidly couple the second channel 308 to the first channel 306. The mixer 336 is defined by a region of the first channel 306 where the set of channels 342 exhaust into the first channel 306. The mixer 336 is provided upstream of the swirler 338.

There can be any number of one or more channels of the set of channels 342 that are circumferentially spaced, axially spaced, or a combination thereof with respect to one another. As a non-limiting example, the set of channels 342 can be formed as a singular row of circumferentially spaced channels. The set of channels 342 can extend at any suitable angle from the second channel 308 and to the first channel 306. As a non-limiting example, the set of channels 342 can each extend from an inlet at the second channel 308 to an outlet at the first channel 306. The outlet can be axially spaced from, circumferentially spaced from, or a combination thereof from the inlet. As a non-limiting example, at least a portion of the channels of the set of channels 342 can have circumferentially spaced inlets and outlets such that the fluid flowing through the at least a portion of the channels is directed in a circumferential direction. As a non-limiting example, the set of channels 342 can be oriented such that the flow of fluid exiting the set of channels 342 and into the first channel 306 is a swirled flow of fluid. The set of channels 342 can be formed with a constant cross-sectional area, as illustrated, or a non-constant cross-sectional area. As a non-limiting example, at least a portion of the channels of the set of channels 342 can be formed as a venturi such that the flow of fluid flowing through the at least the portion of the channels is sped up and pressurized as it flows through the respective flame shaping channel. At least two channels of the set of channels 342 can be formed identical or non-identical to one another.

During operation, a primary flow of fluid (F1) is fed to the first channel 306 and a secondary flow of fluid (F2) is fed to the second channel 308. The primary flow of fluid (F1) and the secondary flow of fluid (F2) can each be a flow of compressed air (e.g., the flow of bleed fluid (Fb) or the flow of cooled air (F) of FIG. 4), a flow of gaseous fuel (e.g., the flow of gaseous fuel (Fg) of FIG. 4), or a combination thereof. At least one of the primary flow of fluid (F1) or the secondary flow of fluid (F2) includes a flow of gaseous fuel. The primary flow of fuel (F1) is mixed with the secondary flow of fluid (F2) within the mixer 336 to define a flow of fuel/air mixture (Fm). The flow of fuel/air mixture (Fm) is fed to the combustion chamber 316. As a non-limiting example, the primary flow of fluid (F1) can be a mixture of gaseous fuel and compressed air, while the secondary flow of fluid (F2) can be a gaseous fuel.

The fuel nozzle assembly 301, in comparison with the fuel nozzle assembly 201 of FIG. 4, has a higher control of the ratio between the compressed air and gaseous fuel at the first outlet 312, an integrally formed mixer 336 within the fuel nozzle 302, a decreased risk of autoignition, and a decreased risk of flashback). The mixing of the gaseous fuel and the compressed air to define the flow of fuel/air mixture (Fm) within the first channel 306 further decreases the total distance that the flow of fuel/air mixture (Fm), defined as the flow of fuel that is intended to be ignited, has to travel before being ignited. This, in turn, reduces the possibility of autoignition and reduces the total distance that a flame can spread if flashback were to occur.

Figure 7:
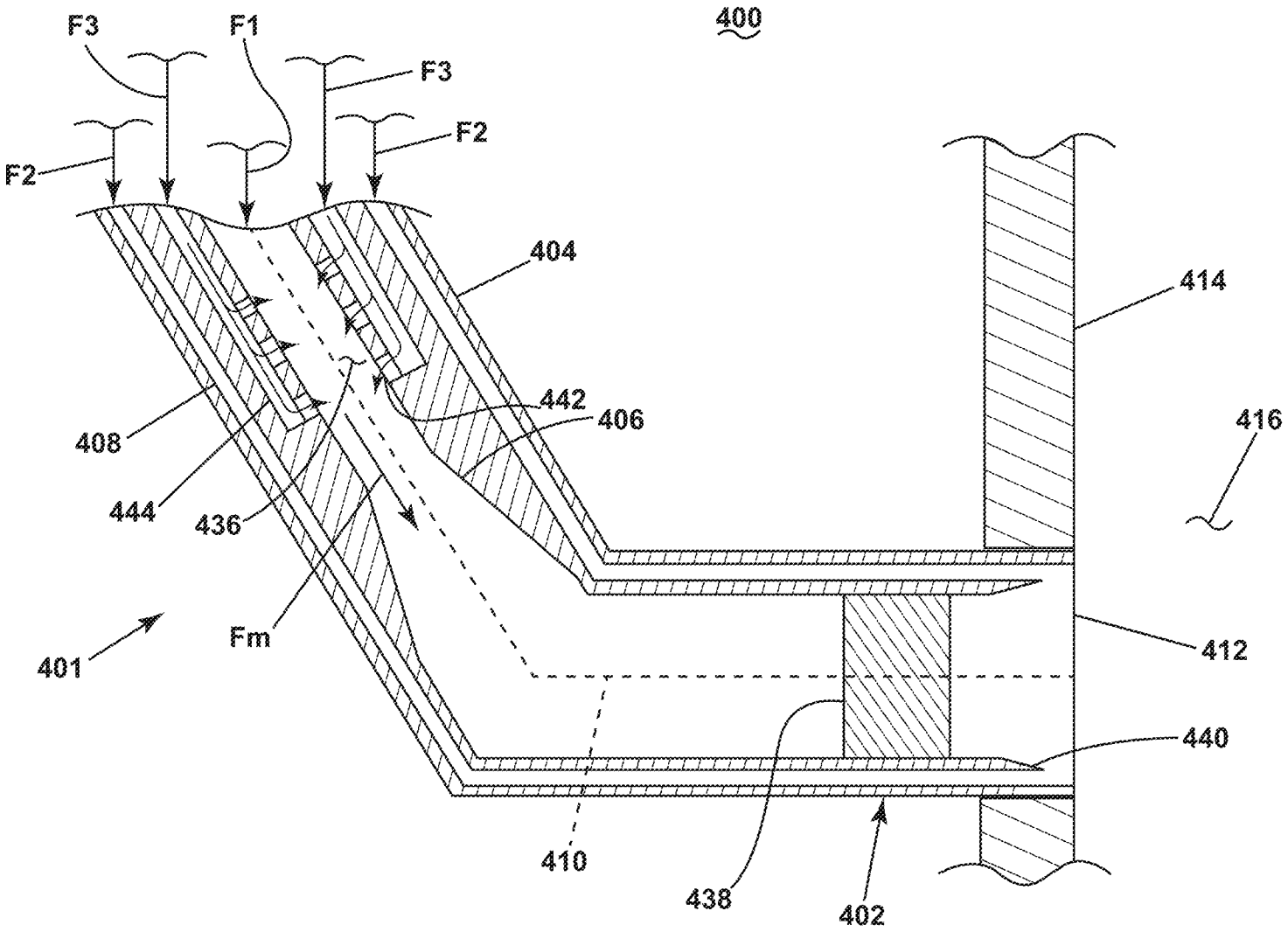
FIG. 7 is a schematic side cross-sectional view of an exemplary combustion section suitable for use as the combustion section of FIG. 1, the combustion section including a fuel nozzle including a first channel, a second channel, and a third channel.

FIG. 7 is a schematic side cross-sectional view of an exemplary combustion section 400 suitable for use as the combustion section 200 of FIG. 1. The combustion section 400 is similar to the combustion section 200 (FIG. 4), 300 (FIG. 6), therefore, like parts will be identified with like numerals increased to the 400 series with it being understood that the description of the combustion section 200, 300 applies to the combustion section 400 unless noted otherwise.

The combustion section 400 includes a fuel nozzle assembly 401, a dome wall 414 and a combustion chamber 416. The fuel nozzle assembly 401 includes a fuel nozzle 402 having a body 404 defining a centerline axis 410. The body 404 defines a first channel 406 and a second channel 408. The first channel 406 exhausts into the combustion chamber 416 at a first outlet 412. The second channel 408 exhausts into the combustion chamber 416 at a second outlet 440. A swirler 438 is provided within the first channel 406. While not illustrated a set of flame shaping holes (e.g., the set of flame shaping holes 220 of FIG. 4) can be provided.

The fuel nozzle assembly 401 includes a third channel 444. The third channel 444, like the second channel 308 (FIG. 4), is fluidly coupled to the first channel 406 through a set of channels 442 to form a mixer 436 provided within the body 404 of the fuel nozzle 402. The third channel 444 can be provided radially between the first channel 406 and the second channel 408 and extend less than an axial extent of the centerline axis 410. The third channel 444, like the first channel 406 and the second channel 408, can be formed as an annular channel that extends about an entirety of or less than an entirety of the centerline axis 410.

During operation, a primary flow of fluid (F1) is fed to the first channel 406, a secondary flow of fluid (F2) is fed to the second channel 408, and a tertiary flow of fluid (F3) is fed to the third channel 444. The primary flow of fluid (F1), the secondary flow of fluid (F2), and the tertiary flow of fluid (F3) can each be a flow of compressed air (e.g., the flow of bleed fluid (Fb) or the flow of cooled air (F) of FIG. 4), a flow of gaseous fuel (e.g., the flow of gaseous fuel (Fg) of FIG. 4), or a combination thereof. At least one of the primary flow of fluid (F1), the secondary flow of fluid (F2), or the tertiary flow of fluid (F3) includes a flow of gaseous fuel. The primary flow of fuel (F1) is mixed with the tertiary flow of fluid (F3) within the mixer 436 to define a flow of fuel/air mixture (Fm). The flow of fuel/air mixture (Fm) is fed to the combustion chamber 416.

The fuel nozzle assembly 401, like the fuel nozzle assembly 301 of FIG. 6, includes the mixer 436 integrally formed with the fuel nozzle 402, thus reducing the possibility of flashback and auto-ignition, while being able to better control the ratio between the gaseous fuel and the compressed air to define the flow of fuel/air mixture (Fm). The fuel nozzle assembly 401 in comparison with the fuel nozzle assembly 301, however, has further flame shaping and insulative capabilities as the fuel nozzle assembly 401 includes the second channel 408 exhausting the secondary flow of fluid (F3) into the combustion chamber 416. As a non-limiting example, the primary flow of fluid (F1) can be a compressed air, the secondary flow of fluid (F2) can be a compressed air, while the tertiary flow of fluid (F3) can be a gaseous fuel.

It is contemplated that the secondary flow of fluid (F2) can be a flow of gaseous fuel such that a flow of gaseous fuel is exhausted directly into the combustion chamber 416 at the second outlet 440. The exhausting of the gaseous fuel at the second outlet 440 can further increase the ratio of gaseous fuel to compressed air that is ignited to define the flame within the combustion chamber. This, in turn, results in a hotter and faster moving flame which can ultimately result in an increased power output of the turbine engine.

Figure 8:
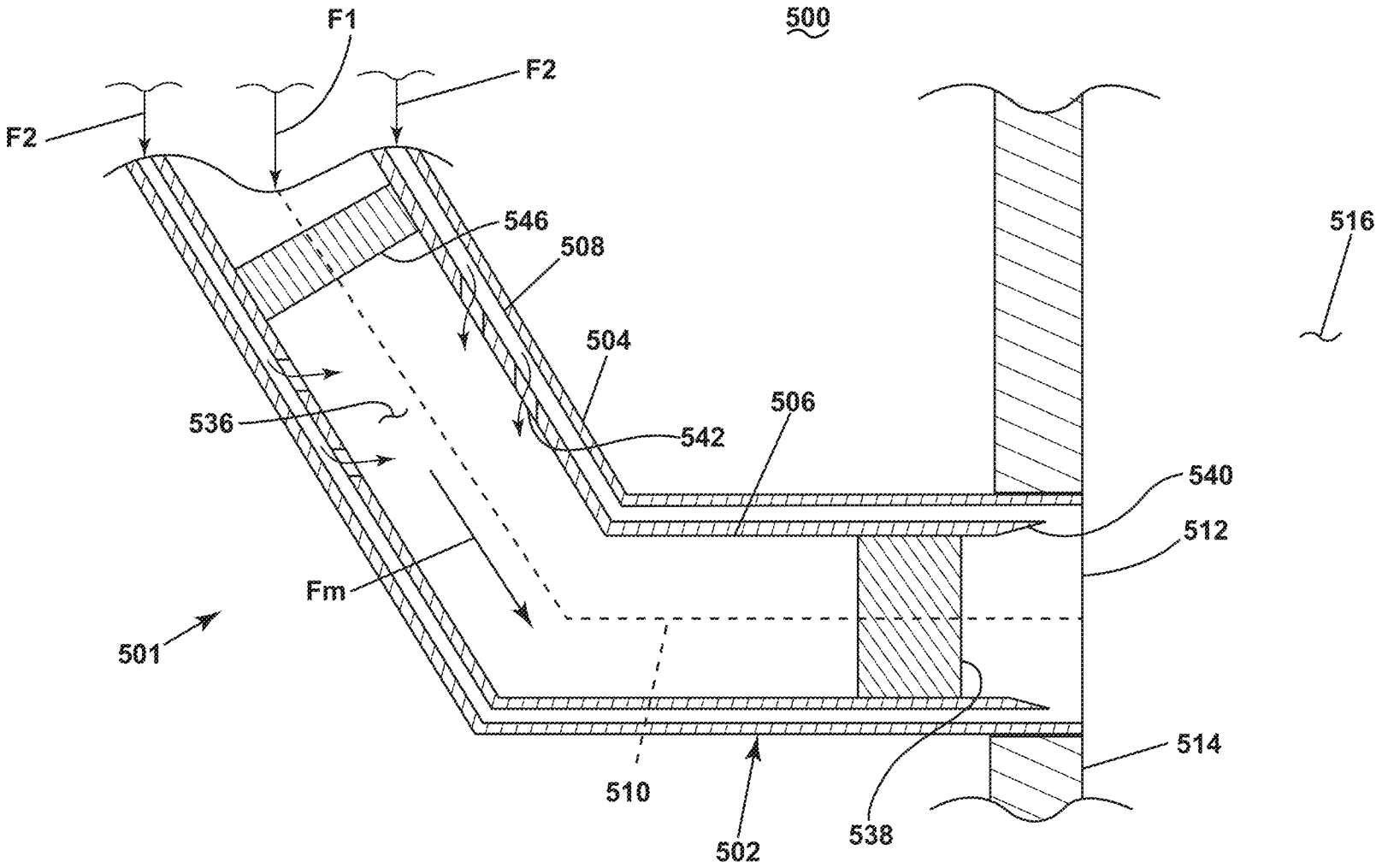
FIG. 8 is a schematic side cross-sectional view of an exemplary combustion section suitable for use as the combustion section of FIG. 1, the combustion section including a fuel nozzle including a first channel, a second channel, a first swirler, and a second swirler.

FIG. 8 is a schematic side cross-sectional view of an exemplary combustion section 500 suitable for use as the combustion section 200 of FIG. 1. The combustion section 500 is similar to the combustion section 200 (FIG. 5), 300 (FIG. 6), 400 (FIG. 7), therefore, like parts will be identified with like numerals increased to the 500 series with it being understood that the description of the combustion section 200, 300, 400 applies to the combustion section 500 unless noted otherwise.

The combustion section 500 includes a fuel nozzle assembly 501, a dome wall 514 and a combustion chamber 516. The fuel nozzle assembly 501 includes a fuel nozzle 502 having a body 504 defining a centerline axis 510. The body 504 defines a first channel 506 and a second channel 508. The first channel 506 exhausts into the combustion chamber 516 at a first outlet 512. The second channel 508 exhausts into the combustion chamber 516 at a second outlet 540. A first swirler 538 is provided within the first channel 506. While not illustrated, a second channel (e.g., the second channel 208 of FIG. 5), a set of flame shaping holes (e.g., the set of flame shaping holes 220 of FIG. 5), or a combination thereof can be provided.

The fuel nozzle assembly 501, like the fuel nozzle assembly 301 (FIG. 6), 401 (FIG. 7), includes a set of flame shaping holes 542 fluidly coupling the second channel 508 to the first channel 506 to form a mixer 536 within the body 504 of the fuel nozzle 502. The fuel nozzle assembly 501, however, includes a second swirler 546 provided upstream of the mixer 536 and within the first channel 506. The second swirler 546 can be formed the same or different from the first swirler 538.

During operation, a primary flow of fluid (F1) is fed to the first channel 506 and a secondary flow of fluid (F2) is fed to the second channel 508. The primary flow of fluid (F1) and the secondary flow of fluid (F2) can each be a flow of compressed air (e.g., the flow of bleed fluid (Fb) or the flow of cooled air (F) of FIG. 5), a flow of gaseous fuel (e.g., the flow of gaseous fuel (Fg) of FIG. 5), or a combination thereof. At least one of the primary flow of fluid (F1) or the secondary flow of fluid (F2) includes a flow of gaseous fuel. The primary flow of fuel (F1) is mixed with the secondary flow of fluid (F2) within the mixer 536 to define a flow of fuel/air mixture (Fm). The flow of fuel/air mixture (Fm) is fed to the combustion chamber 516. As a non-limiting example, the primary flow of fluid (F1) can be a compressed air, while the secondary flow of fluid (F2) can be a gaseous fuel.

The fuel nozzle assembly 501, like the fuel nozzle assembly 301 and 401, includes the mixer 536 integrally formed with the fuel nozzle 502, thus reducing the possibility of flashback and auto-ignition, while being able to better control the ratio between the gaseous fuel and the compressed air to define the flow of fuel/air mixture (Fm). The fuel nozzle assembly 501 in comparison with the fuel nozzle assembly 301, however, has further flame shaping capabilities as the fuel nozzle assembly 501 includes the second channel 508 exhausting into the combustion chamber 516 at the second outlet 540. The exhausting of the secondary flow of fluid (F2) at the second outlet 540 can, in turn, help in flame shaping like the second channel 208 of FIG. 4.

Figure 9:
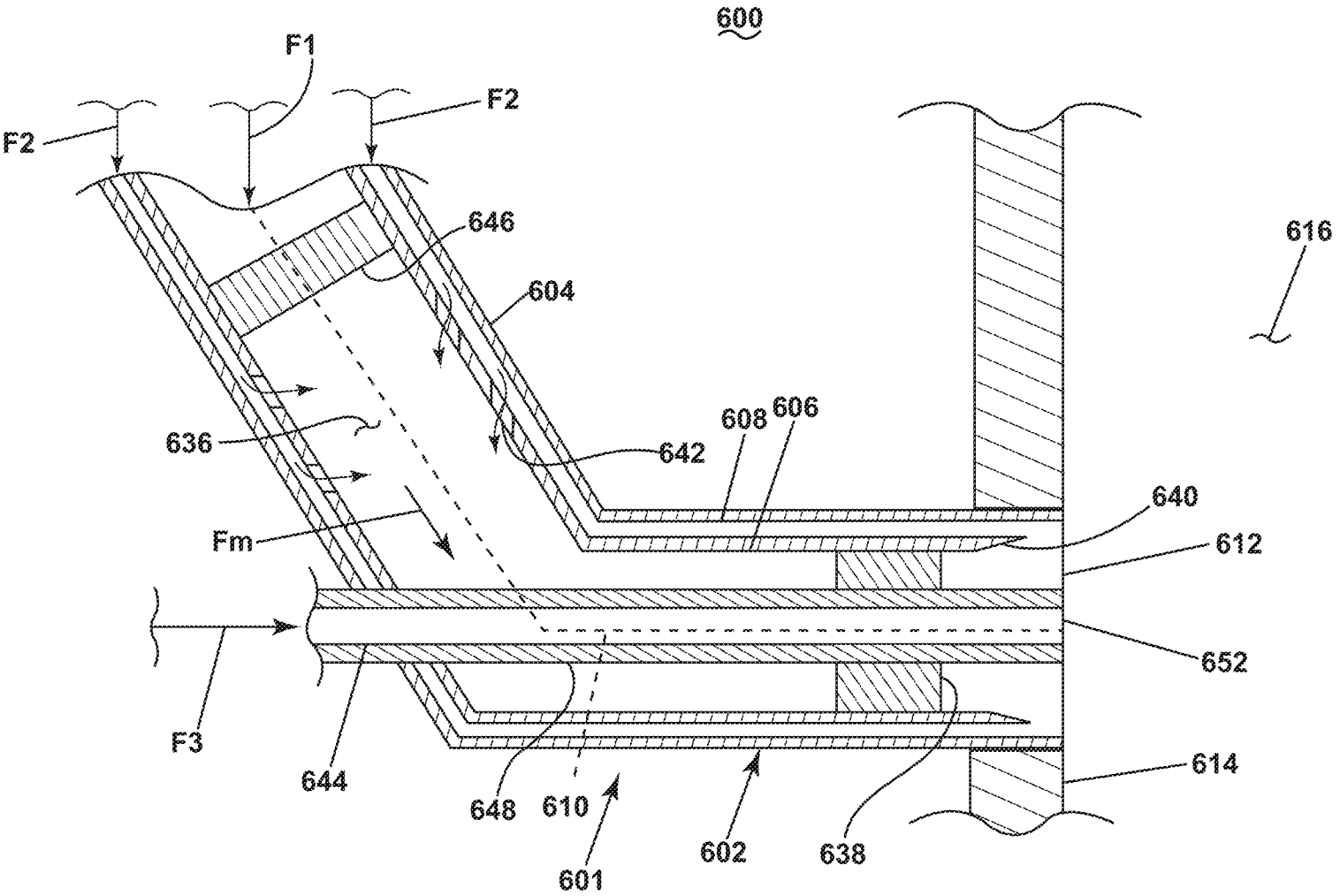
FIG. 9 is a schematic side cross-sectional view of an exemplary combustion section suitable for use as the combustion section of FIG. 1, the combustion section including a fuel nozzle including a first body defining a first channel, and a second channel, and a second body defining a third channel.

FIG. 9 is a schematic side cross-sectional view of an exemplary combustion section 600 suitable for use as the combustion section 200 of FIG. 1. The combustion section 600 is similar to the combustion section 200 (FIG. 6), 300 (FIG. 6), 400 (FIG. 7), 500 (FIG. 8), therefore, like parts will be identified with like numerals increased to the 600 series with it being understood that the description of the combustion section 200, 300, 400, 500 applies to the combustion section 600 unless noted otherwise.

The combustion section 600 includes a fuel nozzle assembly 601, a dome wall 614 and a combustion chamber 616. The fuel nozzle assembly 601 includes a fuel nozzle 602 having a first body 604 defining a centerline axis 610. The first body 604 defines a first channel 606 and a second channel 608. The first channel 606 exhausts into the combustion chamber 616 at a first outlet 612. The second channel 608 exhausts into the combustion chamber 616 at a second outlet 640. A first swirler 638 is provided within the first channel 606. While not illustrated, a second channel (e.g., the second channel 208 of FIG. 6), a set of flame shaping holes (e.g., the set of flame shaping holes 220 of FIG. 6), or a combination thereof can be provided.

The fuel nozzle assembly 601, like the fuel nozzle assembly 301 (FIG. 6), 401 (FIG. 7), 501 (FIG. 8), includes a set of channels 642 fluidly coupling the second channel 608 to the first channel 606 to form a mixer 636 within the first body 604 of the fuel nozzle 602. The fuel nozzle assembly 601, like the fuel nozzle assembly 501, includes a second swirler 646 upstream of the mixer 636.

The fuel nozzle assembly 601, however, further includes a second body 648 having a third channel 644 exhausting into the combustion chamber 616 at a third outlet 652. The second body 648 can be separate from or integrally formed with the first body 604. As a non-limiting example, the second body 648 can be formed separate from the first body 604 such that the second body 648 is positioned within the first body 604 and coupled to the first body 604 through any suitable method such as, but not limited to, welding, adhesion, fastening, bonding, or the like. At least a portion of the second body 648 can extend through the first channel 606, the second channel 608 or a combination thereof. The second body 648 can extend along at least a portion of the centerline axis 610. The first swirler 638 can extend circumferentially around the second body 648.

During operation, a primary flow of fluid (F1) is fed to the first channel 606, a secondary flow of fluid (F2) is fed to the second channel 608, and a tertiary flow of fluid (F3) is fed to the third channel 644. The primary flow of fluid (F1), the secondary flow of fluid (F2), and the tertiary flow of fluid (F3) can each be a flow of compressed air (e.g., the flow of bleed fluid (Fb) or the flow of cooled air (Fc) of FIG. 6), a flow of gaseous fuel (e.g., the flow of gaseous fuel (Fg) of FIG. 6), or a combination thereof. At least one of the primary flow of fluid (F1), the secondary flow of fluid (F2), or the tertiary flow of fluid (F3) includes a flow of gaseous fuel. The secondary flow of fluid (F2) is mixed with the primary flow of fluid (F1) through set of channels 642.

The flow of fuel/air mixture (Fm) is fed to the combustion chamber 616. A set of auxiliary channels (not illustrated) can be provided within the second body 648 to fluidly couple the third channel 644 to the first channel 606. The third channel 644 can be used for additional flame shaping and insulative capabilities. As a non-limiting example, the tertiary flow of fluid (F3) can be used to push the flame away from the dome wall 614. As a non-limiting example, the primary flow of fluid (F1) can be a compressed air, the secondary flow of fluid (F2) can be a gaseous fuel, and the tertiary flow of fluid (F3) can be a compressed air.

Figure 10:
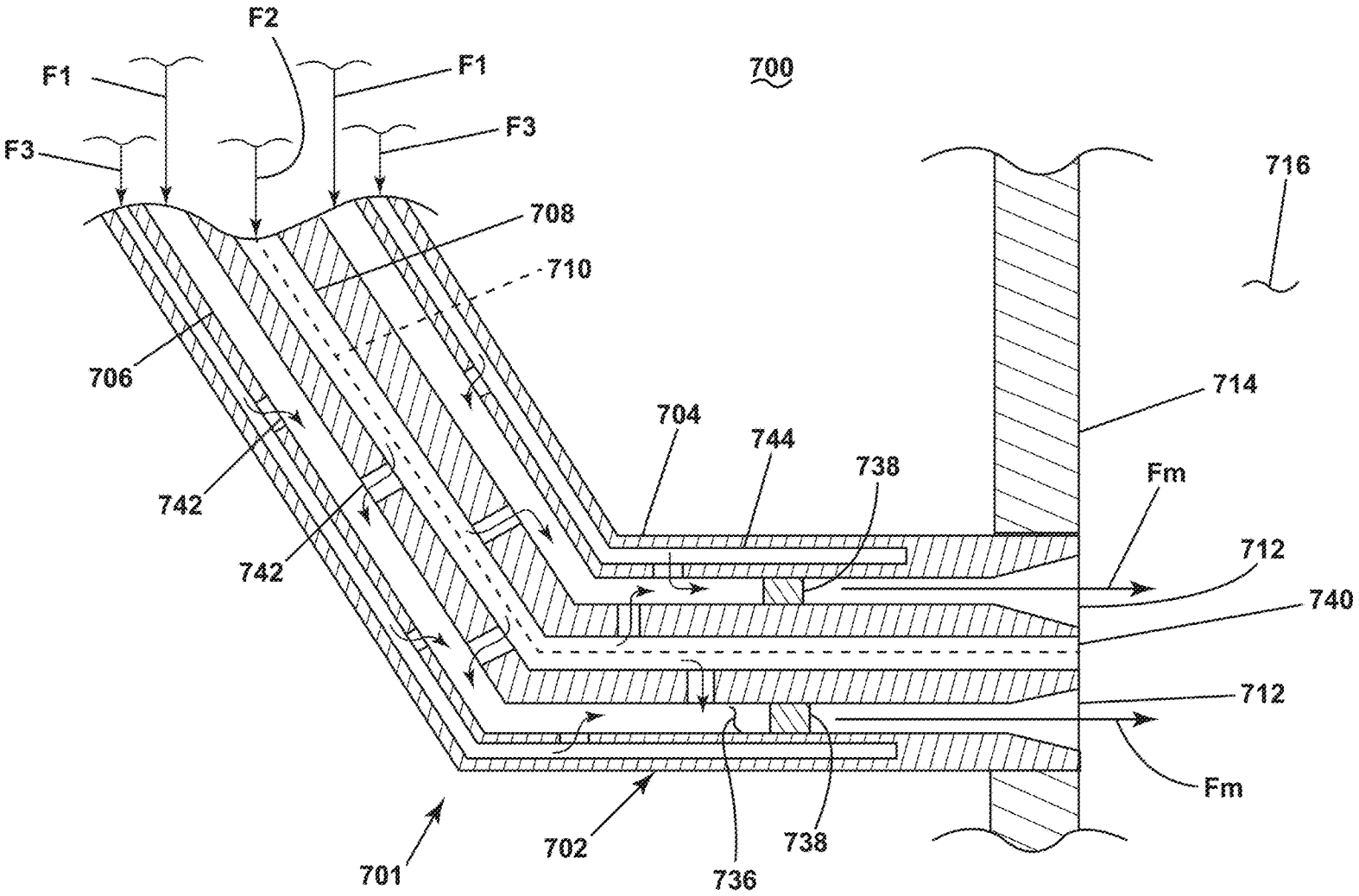
FIG. 10 is a schematic side cross-sectional view of an exemplary combustion section suitable for use as the combustion section of FIG. 1, the combustion section including a fuel nozzle including a first channel, a second channel, and a third channel.

FIG. 10 is a schematic side cross-sectional view of an exemplary combustion section 700 suitable for use as the combustion section 200 of FIG. 1. The combustion section 700 is similar to the combustion section 200 (FIG. 7), 300 (FIG. 7), 400 (FIG. 7), 500 (FIG. 8), 600 (FIG. 9), therefore, like parts will be identified with like numerals increased to the 700 series with it being understood that the description of the combustion section 200, 300, 400, 500, 600 applies to the combustion section 700 unless noted otherwise.

The combustion section 700 includes a fuel nozzle assembly 701, a dome wall 714 and a combustion chamber 716. The fuel nozzle assembly 701 includes a fuel nozzle 702 having a body 704 defining a centerline axis 710. The body 704 defines a first channel 706 and a second channel 708. The first channel 706 exhausts into the combustion chamber 716 at a first outlet 712. The second channel 708 exhausts into the combustion chamber 716 at a second outlet 740. A swirler 738 is provided within the first channel 706. While not illustrated, a set of flame shaping holes (e.g., the set of flame shaping holes 220 of FIG. 7) can be provided.

The fuel nozzle assembly 701, like the fuel nozzle assembly 401 (FIG. 7), 601 (FIG. 9), includes a third channel 744. The third channel 744, however, circumscribes the first channel 706 which circumscribes the second channel 708. While the third channel 744 is illustrated as being the radially outermost channel, it will be appreciated that any suitable configuration or number of channels is possible. The second channel 708 and the third channel 744 are each fluidly coupled to the first channel 706 through a set of channels 742 to form a mixer 736 within the body 704 of the fuel nozzle 702. The third channel 744 terminates upstream of the combustion chamber 716. Alternatively, the third channel 744 can exhaust directly into the combustion chamber 716 at a third outlet (not illustrated).

During operation, a primary flow of fluid (F1) is fed to the first channel 706, a secondary flow of fluid (F2) is fed to the second channel 708, and a tertiary flow of fluid (F3) is fed to the third channel 744. The primary flow of fluid (F1), the secondary flow of fluid (F2), and the tertiary flow of fluid (F3) can each be a flow of compressed air (e.g., the flow of bleed fluid (Fb) or the flow of cooled air (F) of FIG. 7), a flow of gaseous fuel (e.g., the flow of gaseous fuel (Fg) of FIG. 7), or a combination thereof. At least one of the primary flow of fluid (F1), the secondary flow of fluid (F2), or the tertiary flow of fluid (F3) includes a flow of gaseous fuel. The primary flow of fuel (F1) is mixed with the tertiary flow of fluid (F3) within the mixer 736 to define a flow of fuel/air mixture (Fm). The flow of fuel/air mixture (Fm) is fed to the combustion chamber 716. The second channel 708 can be used for additional flame shaping and insulative capabilities. As a non-limiting example, the secondary fluid flow (F2) can be used to push the flame away from the dome wall 714. As a non-limiting example, the primary flow of fluid (F1) can be a compressed air, the secondary flow of fluid (F2) can be a gaseous fuel, and the tertiary flow of fluid (F3) can be a gaseous fuel.

Benefits of the present disclosure include a combustor suitable for use with a gaseous H2 fuel. As outlined previously, gaseous H2 fuels have a higher flame temperature, likelihood for flashback and likelihood for auto-ignition than traditional fuels (e.g., fuels not containing hydrogen). That is, gaseous H2 fuels have a wider flammable range and a faster burning velocity than traditional fuels such petroleum-based fuels, or petroleum and synthetic fuel blends. These high burn temperatures of gaseous H2 fuels mean that additional insulation is needed between the ignited gaseous H2 fuel and surrounding components of the turbine engine or gas turbine engine (e.g., the dome wall, the inner/outer liner, and other parts of the turbine engine). Further, additional structure to mitigate flashback and stop undesired auto-ignition is needed; problems not faced by combustors utilizing traditional fuels. The combustor, as described herein, includes a fuel nozzle assembly that provides a layer of insulation between the flame and portions of the combustion section, keeps the mixed flow of fuel below the auto-ignition temperature, and prevents flashback from accruing within the fuel nozzle. The fuel nozzle assembly further aides in flame shaping which helps with ensuring liner wall temperature, the dome wall temperature, the combustor exit temperature profile and pattern of the flame/gas exiting the combustor can be controlled. This control or shaping can further ensure that the combustion section or otherwise hot sections of the turbine engine do not fail or otherwise become ineffective by being overly heated, thus increasing the lifespan of the turbine engine. That is, the fuel nozzle assembly, as described herein, ensure an even, uniform, or otherwise desired flame propagation within the combustor.

Benefits associated with using gaseous hydrogen-containing fuel over traditional fuels include an eco-friendlier engine as the hydrogen-containing fuel, when combusted, generates less carbon pollutants than a combustor using traditional fuels. For example, a combustor including 100% gaseous hydrogen-containing fuel (e.g., the fuel is 100% H2) would have zero carbon pollutants. The combustor, as described herein, can be used in instances where 100% gaseous hydrogen-containing fuel is used.

To the extent not already described, the different features and structures of the various embodiments can be used in combination, or in substitution with each other as desired. That one feature is not illustrated in all of the embodiments is not meant to be construed that it cannot be so illustrated, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects are provided by the subject matter of the following clauses:

A turbine engine comprising, a compressor section, a combustion section, and a turbine section in serial flow arrangement, with the compressor section defining a compressed air supply, the combustion section comprising a combustion liner and dome wall collectively forming at least a portion of a combustion chamber, with the dome wall having a fuel nozzle opening, and a fuel nozzle assembly extending through the fuel nozzle opening, the fuel nozzle assembly comprising a gaseous fuel supply having a flow of gaseous fuel, a compressed air supply having a flow of compressed air, and a mixer fluidly receiving the flow of gaseous fuel and the flow of compressed air, and outputting a flow of fuel/air mixture, a fuel nozzle having a first body defining a centerline axis, the first body defining a first channel fluidly coupled to the mixer to receive the flow of fuel/air mixture, and a second channel fluidly coupled to at least one of the gaseous fuel supply or the compressed air supply, and a first swirler provided within the first channel downstream of the mixer.

The turbine engine of any preceding clause, wherein the second channel is an annular channel circumscribing the first channel.

The turbine engine of any preceding clause, wherein the second channel is fluidly coupled to only the gaseous fuel supply.

The turbine engine of any preceding clause, further comprising a liquid fuel supply having a flow of liquid fuel, wherein the fuel nozzle assembly further comprises a heat exchanger fluidly coupled to the compressed air supply and the liquid fuel supply, with a heat transfer between the flow of compressed air and the flow of liquid fuel within the heat exchanger being sufficient to cause a phase change of the flow of liquid fuel to the flow of gaseous fuel.

The turbine engine of any preceding clause, wherein the second channel is fluidly coupled to a flow of compressed air exiting the heat exchanger.

The turbine engine of any preceding clause, wherein the mixer is provided exterior the fuel nozzle.

The turbine engine of any preceding clause, wherein the first body defines the mixer.

The turbine engine of any preceding clause, wherein the mixer is defined by a portion of the first channel.

The turbine engine of any preceding clause, wherein the fuel nozzle includes a set of channels fluidly coupling the second channel to the first channel to define the mixer.

The turbine engine of any preceding clause, wherein the set of channels are axially spaced along the first channel.

The turbine engine of any preceding clause, further comprising a third channel fluidly coupled to the gaseous fuel supply, the compressed air supply, or a combination thereof.

The turbine engine of any preceding clause, wherein the second channel and the third channel are fluidly coupled to the first channel through a set of channels.

The turbine engine of any preceding clause, wherein the third channel is provided radially inward from the first channel, and the first channel is provided radially inward from the second channel.

The turbine engine of any preceding clause, wherein the fuel nozzle assembly includes a second body, separate from the first body, that includes the third channel.

The turbine engine of any preceding clause, wherein the first channel exhausts into the combustion chamber at a first outlet, and the second channel exhausts into the combustion chamber at a second outlet.

The turbine engine of any preceding clause, wherein the second channel terminates axially prior to the combustion chamber.

The turbine engine of any preceding clause, wherein the first swirler is provided downstream of the mixer.

The turbine engine of any preceding clause, further comprising a second swirler provided upstream of the mixer.

A method of operating the combustion section of any preceding clause the method comprising mixing the flow of gaseous fuel including a gaseous hydrogen with the flow of compressed air from the compressed air supply to define a flow of fuel/air mixture, supplying the flow of fuel/air mixture to the combustion chamber through the first channel, and supplying at least one of the flow of compressed air or the flow of gaseous fuel to the combustion chamber through the second channel.

A method of operating the combustion section of any preceding clause, the method comprising supplying the flow of gaseous fuel to the first channel, supplying the flow of compressed air to the second channel, and cooling the flow of gaseous fuel within the first channel through a transfer of heat between the flow of compressed air in the second channel and the flow of gaseous fuel in order to keep the flow of gaseous fuel within the first channel below an auto-ignition temperature of the flow of gaseous fuel.

A combustion section comprising a combustion liner and dome wall collectively forming at least a portion of a combustion chamber, with the dome wall having a fuel nozzle opening, and a fuel nozzle assembly extending through the fuel nozzle opening, the fuel nozzle assembly comprising a gaseous fuel supply having a flow of gaseous fuel, a compressed air supply having a flow of compressed air, and a mixer fluidly receiving the flow of gaseous fuel and the flow of compressed air, and outputting a flow of fuel/air mixture, a fuel nozzle having a first body defining a centerline axis, the first body defining a first channel fluidly coupled to the mixer to receive the flow of fuel/air mixture, and a second channel fluidly coupled to at least one of the gaseous fuel supply or the compressed air supply, and a first swirler provided within the first channel downstream of the mixer.

The combustion section of any preceding clause, wherein the second channel is an annular channel circumscribing the first channel.

The combustion section of any preceding clause, wherein the second channel is fluidly coupled to only the gaseous fuel supply.

The combustion section of any preceding clause, further comprising a liquid fuel supply having a flow of liquid fuel, wherein the fuel nozzle assembly further comprises a heat exchanger fluidly coupled to the compressed air supply and the liquid fuel supply, with a heat transfer between the flow of compressed air and the flow of liquid fuel within the heat exchanger being sufficient to cause a phase change of the flow of liquid fuel to the flow of gaseous fuel.

The combustion section of any preceding clause, wherein the second channel is fluidly coupled to a flow of compressed air exiting the heat exchanger.

The combustion section of any preceding clause, wherein the mixer is provided exterior the fuel nozzle.

The combustion section of any preceding clause, wherein the first body defines the mixer.

The combustion section of any preceding clause, wherein the mixer is defined by a portion of the first channel.

The combustion section of any preceding clause, wherein the fuel nozzle includes a set of channels fluidly coupling the second channel to the first channel to define the mixer.

The combustion section of any preceding clause, wherein the set of channels are axially spaced along the first channel.

The combustion section of any preceding clause, further comprising a third channel fluidly coupled to the gaseous fuel supply, the compressed air supply, or a combination thereof.

The combustion section of any preceding clause, wherein the second channel and the third channel are fluidly coupled to the first channel through a set of channels.

The combustion section of any preceding clause, wherein the third channel is provided radially inward from the first channel, and the first channel is provided radially inward from the second channel.

The combustion section of any preceding clause, wherein the fuel nozzle assembly includes a second body, separate from the first body, that includes the third channel.

The combustion section of any preceding clause, wherein the first channel exhausts into the combustion chamber at a first outlet, and the second channel exhausts into the combustion chamber at a second outlet.

The combustion section of any preceding clause, wherein the second channel terminates axially prior to the combustion chamber.

The combustion section of any preceding clause, wherein the first swirler is provided downstream of the mixer.

The combustion section of any preceding clause, further comprising a second swirler provided upstream of the mixer.

What is claimed is:

1. A turbine engine comprising:

a liquid fuel supply having a flow of liquid fuel; and a compressor section, a combustion section, and a turbine section in serial flow arrangement, with the compressor section defining a compressed air supply having a flow of compressed air, the combustion section comprising:

a combustion liner and a dome wall collectively forming at least a portion of a combustion chamber, with the dome wall having a fuel nozzle opening; and a fuel nozzle assembly extending through the fuel nozzle opening, the fuel nozzle assembly comprising:

a gaseous fuel supply having a flow of gaseous fuel, and a mixer fluidly receiving the flow of gaseous fuel and the flow of compressed air, and outputting a flow of fuel/air mixture;

a fuel nozzle having a first body defining a centerline axis, the first body defining a first channel fluidly coupled to the mixer to receive the flow of fuel/air mixture, and a second channel fluidly coupled to at least one of the gaseous fuel supply or the compressed air supply;

a first swirler provided within the first channel downstream of the mixer; and a heat exchanger fluidly coupled to the compressed air supply and the liquid fuel supply, with a heat transfer between the flow of compressed air and the flow of liquid fuel within the heat exchanger being sufficient to cause a phase change of the flow of liquid fuel to the flow of gaseous fuel.

2. The turbine engine of claim 1, wherein the second channel is an annular channel circumscribing the first channel.

3. The turbine engine of claim 1, wherein the second channel is fluidly coupled to only the gaseous fuel supply.

4. The turbine engine of claim 1, wherein the second channel is fluidly coupled to a flow of compressed air exiting the heat exchanger.

5. The turbine engine of claim 1, wherein the mixer is provided exterior the fuel nozzle.

6. The turbine engine of claim 1, further comprising a third channel fluidly coupled to the gaseous fuel supply, the compressed air supply, or a combination thereof.

7. The turbine engine of claim 6, wherein the second channel, the third channel, or a combination thereof are fluidly coupled to the first channel through a set of channels.

8. The turbine engine of claim 7, wherein the third channel is provided radially inward from the first channel, and the first channel is provided radially inward from the second channel.

9. The turbine engine of claim 7, wherein the fuel nozzle assembly includes a second body, separate from the first body that includes the third channel.

10. The turbine engine of claim 1, wherein the second channel terminates upstream of the combustion chamber.

11. The turbine engine of claim 1, further comprising a second swirler provided upstream of the mixer.

12. A method of operating the combustion section of claim 1, the method comprising:

mixing the flow of gaseous fuel including a gaseous hydrogen with the flow of compressed air from the compressed air supply to define the flow of fuel/air mixture;

supplying the flow of fuel/air mixture to the combustion chamber through the first channel; and supplying at least one of the flow of compressed air or the flow of gaseous fuel to the combustion chamber through the second channel.

13. The turbine engine of claim 1, wherein the heat exchanger is fluidly coupled to a liquid fuel supply that is provided exterior the turbine engine.

14. A turbine engine comprising:

a compressor section, a combustion section, and a turbine section in serial flow arrangement, with the compressor section defining a compressed air supply having a flow of compressed air, the combustion section comprising:

a combustion liner and a dome wall collectively forming at least a portion of a combustion chamber, with the dome wall having a fuel nozzle opening; and a fuel nozzle assembly extending through the fuel nozzle opening, the fuel nozzle assembly comprising:

a gaseous fuel supply having a flow of gaseous fuel, and a mixer fluidly receiving the flow of gaseous fuel and the flow of compressed air, and outputting a flow of fuel/air mixture;

a fuel nozzle having a first body defining a centerline axis, the first body defining a first channel fluidly coupled to the mixer to receive the flow of fuel/air mixture, and a second channel fluidly coupled to at least one of the gaseous fuel supply or the compressed air supply, the fuel nozzle including a set of channels fluidly coupling the second channel to the first channel to define the mixer; and a first swirler provided within the first channel downstream of the mixer;

wherein the set of channels are axially spaced along the first channel.

15. The turbine engine of claim 14, wherein the first body defines the mixer.

16. The turbine engine of claim 15, wherein the mixer is defined by a portion of the first channel.

17. The turbine engine of claim 14, further comprising a liquid fuel supply having a flow of liquid fuel, wherein the fuel nozzle assembly further comprises a heat exchanger fluidly coupled to the compressed air supply and the liquid fuel supply, with a heat transfer between the flow of compressed air and the flow of liquid fuel within the heat exchanger being sufficient to cause a phase change of the flow of liquid fuel to the flow of gaseous fuel.

18. A turbine engine comprising:

a liquid fuel supply having a flow of liquid fuel;

a compressor section, a combustion section, and a turbine section in serial flow arrangement, with the compressor section defining a compressed air supply having a flow of compressed air, the combustion section comprising:

a combustion liner and a dome wall collectively forming at least a portion of a combustion chamber, with the dome wall having a fuel nozzle opening; and a fuel nozzle assembly extending through the fuel nozzle opening, the fuel nozzle assembly comprising:

a gaseous fuel supply having a flow of gaseous fuel, and a mixer fluidly receiving the flow of gaseous fuel and the flow of compressed air, and outputting a flow of fuel/air mixture;

a fuel nozzle having a first body defining a centerline axis, the first body defining a first channel fluidly coupled to the mixer to receive the flow of fuel/air mixture, and a second channel fluidly coupled to at least one of the gaseous fuel supply or the compressed air supply;

a first swirler provided within the first channel downstream of the mixer; and a heat exchanger fluidly coupled to the compressed air supply and the liquid fuel supply, with a heat transfer between the flow of compressed air and the flow of liquid fuel within the heat exchanger being sufficient to cause a phase change of the flow of liquid fuel to the flow of gaseous fuel, wherein the combustion section is configured to operate by:

supplying the flow of gaseous fuel to the first channel;

supplying the flow of compressed air to the second channel; and cooling the flow of gaseous fuel within the first channel through a transfer of heat between the flow of compressed air in the second channel and the flow of gaseous fuel in order to keep the flow of gaseous fuel within the first channel below an auto-ignition temperature of the flow of gaseous fuel.

19. The turbine engine of claim 18, wherein the mixer is provided within the fuel nozzle.

* * * * *